United States Patent [19]

Blomquist

[11] 3,942,622

[45] Mar. 9, 1976

[54] DOCUMENT STOP AND POSITION INDICATOR MECHANISM

[75] Inventor: James E. Blomquist, Riverton, Wyo.

[73] Assignee: Victor Comptometer Corporation, Chicago, Ill.

[22] Filed: Nov. 6, 1974

[21] Appl. No.: 521,176

[52] U.S. Cl. ..... 197/127 R; 197/148; 197/190; 101/407 BP

[51] Int. Cl.[2] ..... B41J 13/00

[58] Field of Search ..... 197/127, 190, 180, 187, 197/189, 141, 148; 271/233, 242, 253, 255, DIG. 9; 116/124 R, 129 N, DIG. 14; 270/68 A, 68 R; 101/407 BP

[56] References Cited

UNITED STATES PATENTS

| | | | |
|---|---|---|---|
| 1,229,849 | 6/1917 | Zeitz | 271/255 |
| 1,512,309 | 10/1924 | Read | 197/127 R |
| 2,422,025 | 6/1947 | Luck | 116/124 R |
| 3,856,293 | 12/1974 | Boyer | 270/68 A |

*Primary Examiner*—Edgar S. Burr
*Assistant Examiner*—A. Heinz
*Attorney, Agent, or Firm*—McCaleb, Lucas & Brugman

[57] ABSTRACT

For use in a business machine having a printer and a platen for backing documents during printing, a document stop and position indicator mechanism comprising, in preferred form: movable document stop means for vertically supporting a document at a preselected printing position relative to the platen, a manually rotatable drive shaft mounting gearing engaging gear linkage connected to the document stop means for adjusting the document printing position by raising or lowering the document stop means, a flexible band having ends thereof secured to the document stop means, and band guide means, comprising pulleys, for training the band past a viewing point, the band being calibrated to identify thereat the document printing position established by knob rotation of the drive shaft.

5 Claims, 7 Drawing Figures

10
11
12
13
14
15
16
17
18
19
21
22
23
24
25
26
27
29
31
32
34
43
44
46
47
48
49
51
52
53
54
71
72
73
74
75
76
77
78, 79
81
82
83
84
85
86
87
88
89
4.
4.

DOCUMENT STOP AND POSITION INDICATOR MECHANISM

BACKGROUND OF THE INVENTION

1. Field of the Invention

The present invention relates in general to business machines having printers, and, more particularly, to novel document-handling apparatus for use therein.

2. Description of the Prior Art

Printing business machines, such as accounting machines, when used for multiple business functions, are not readily adapted for printing on continuous form customer invoices or statements. In using such machines to prepare individual customer invoices at regular billing intervals, new balance forward entries must be printed on separate invoice documents at predetermined entry lines or locations thereon. In the past, separate vertical adjustment of invoices or other documents to predetermined printing positions has been a time-consuming procedure, particuarly where a large volume must be printed.

SUMMARY OF THE INVENTION

The present invention is a simple solution to this problem, and comprises a document stop and position indicator mechanism for enabling easy and rapid adjustment of a document to a predetermined printing position. A calibrated indicating band is provided to identify at a viewing point the particular printing line or position of a document that is supported by the stop, the viewing point preferably being a window mounted in the frame of the business machine. Separate adjustment of each similar customer document therefore is not necessary, each such invoice or document simply being required to be inserted into the machine in engagement with the stop means.

More specifically, the present invention is a document stop and position indicator mechanism in a printing business machine having a platen for backing documents during printing which comprises: movable document stop means for supporting a document at a preselected printing position relative to the platen, means for guiding the document stop means, manually operable means for adjusting the document by moving the document stop means, a flexible band having ends thereof secured to the document stop means, and band guide means for training the band past a viewing point, the band being calibrated to indicate at the viewing point the particular line of the document then disposed in print-receiving position. The document stop means preferably is raised or lowered by means of an adjustment knob. Where individual documents, such as ledger cards, require posting at different positions or lines, as is frequently encountered in entering customer debits and credits, document position adjustment is easily accomplished by manually adjusting the document stop means while viewing the calibrated indicating band.

DESCRIPTION OF THE PREFERRED EMBODIMENT

Figure 1:
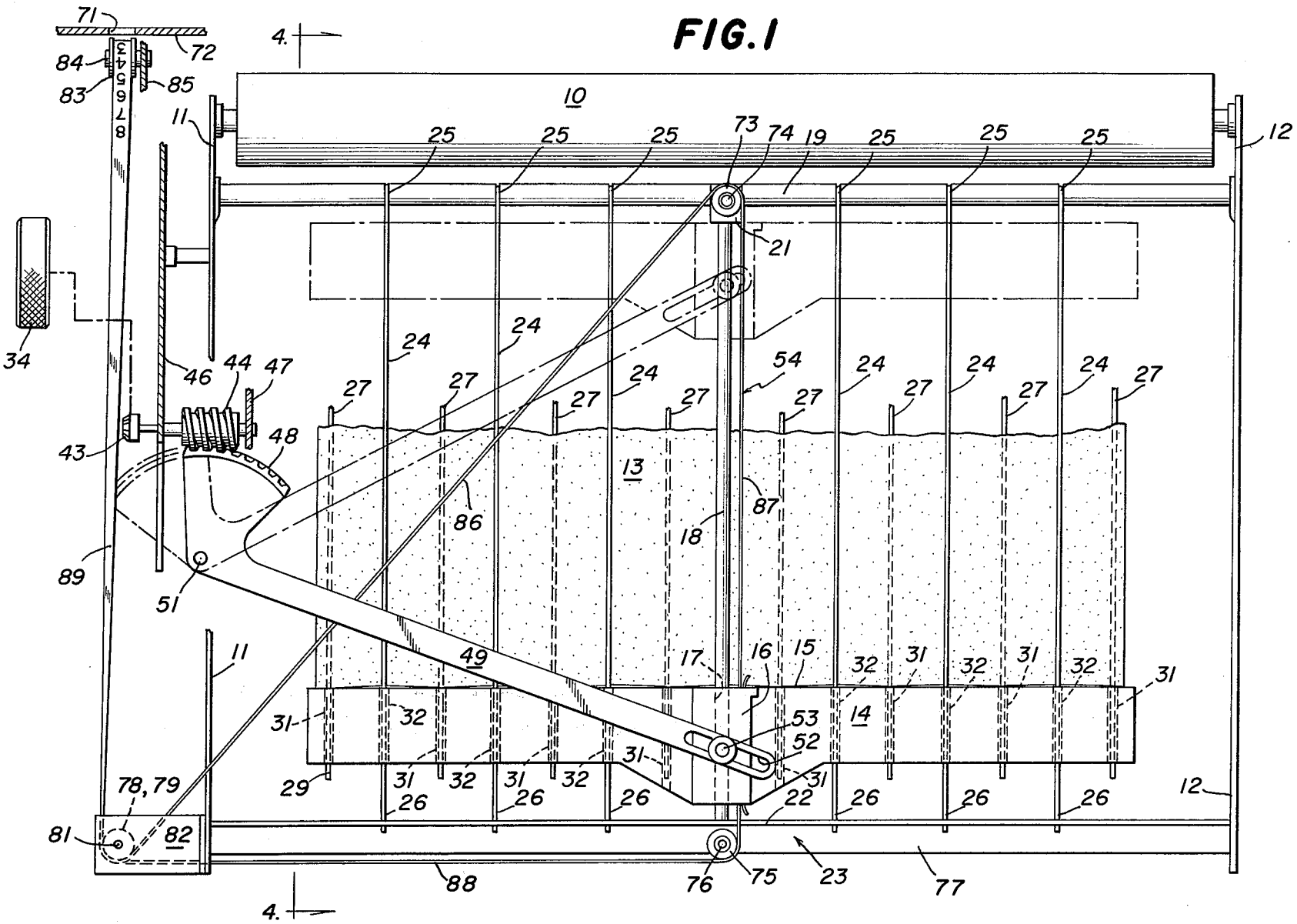
FIG. 1 is a rear elevation view of a business machine, with parts broken away and parts in section, illustrating the basic features of the preferred document stop and position indicator mechanism embodying the present invention.
Figure 3:
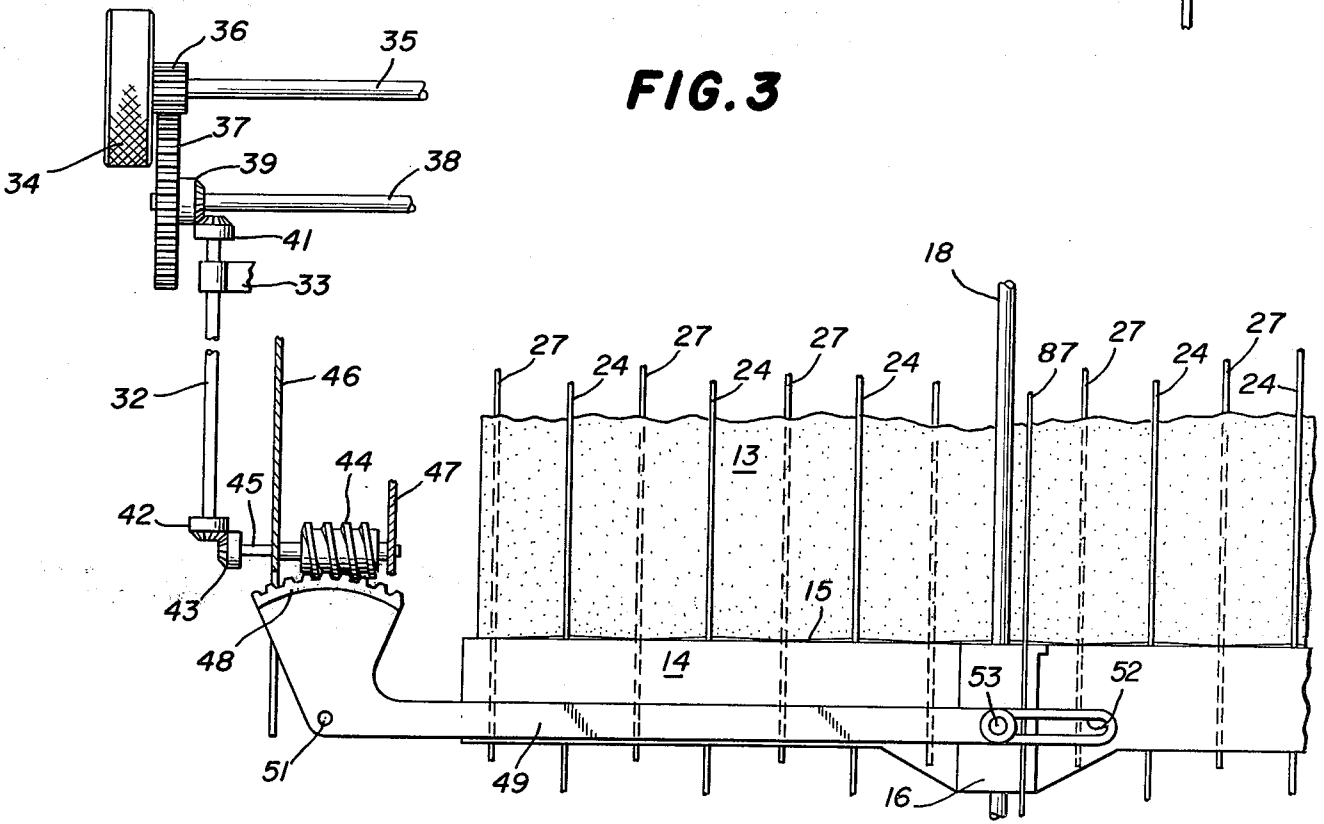
FIG. 3 is a rear elevation illustrating the manually rotatable drive shaft and associated gearing for adjusting the elevation of the document stop means.
Figure 4:
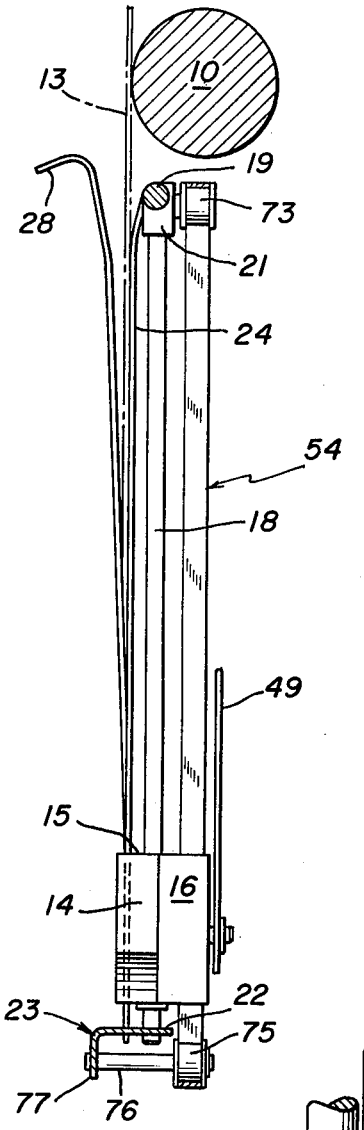
FIG. 4 is a vertical sectional view taken substantially along line 4—4 of FIG. 1 and looking in the direction of the arrows thereon.
Figure 6:
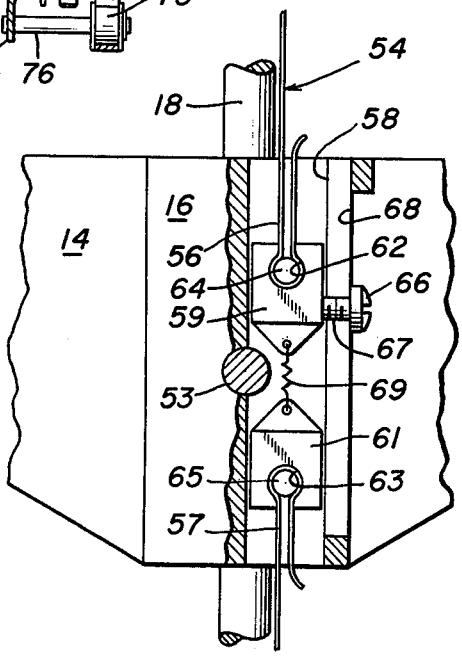
FIG. 6 is a front elevation, with parts broken away and parts in section, showing details of the attachment of the flexible indicating band to the document stop means.
Figure 7:
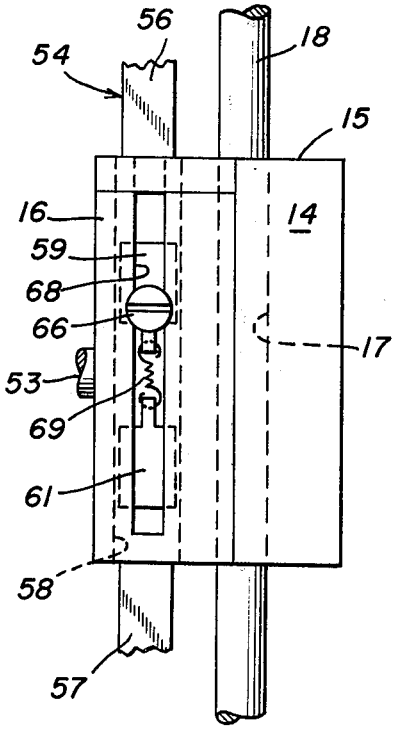
FIG. 7 is a detail side elevational view as seen from the left side of FIG. 6.

The preferred embodiment of the document stop and position indicator mechanism of the present invention is adapted for use with a printing business machine, such as an accounting machine, having a printer (not shown) and a platen 10 (FIGS. 1 and 4) horizontally supported by frame members 11, 12 for backing a document 13, such as an invoice or ledger card, during printing, only a portion of the business machine frame being illustrated for simplification. As best shown in FIGS. 1, 3 and 4, document 13 is supported at a preselected printing position relative to platen 10 by a vertically movable document stop means 14, which comprises a horizontal bar, preferably made of plastic, having a longitudinal axis parallel to the axis of platen 10. Document stop means 14 has an upper document-engaging surface 15 and a central, rearwardly protruding block portion 16 (FIGS. 1, 6 and 7) having a vertical bore 17 therein for sliding engagement with a vertical metal guide rod 18 which is secured to an upper horizontal bar 19 (FIGS. 1, 2 and 4) by means of a plastic T-shaped fitting 21, bar 19 being rigidly fastened at its ends to frame portions 11, 12. The lower end of guide rod 18 is rigidly secured to a horizontal flange 22 (FIGS. 1 and 4) of an L-shaped support 23 fastened to frame sections 11, 12. Document stop means 14 is vertically movable, in a manner to be described, from a bottom position, shown in solid lines on FIG. 1, near flange 22, to an upper position, illustrated in phantom lines, near bar 19.

Figure 2:
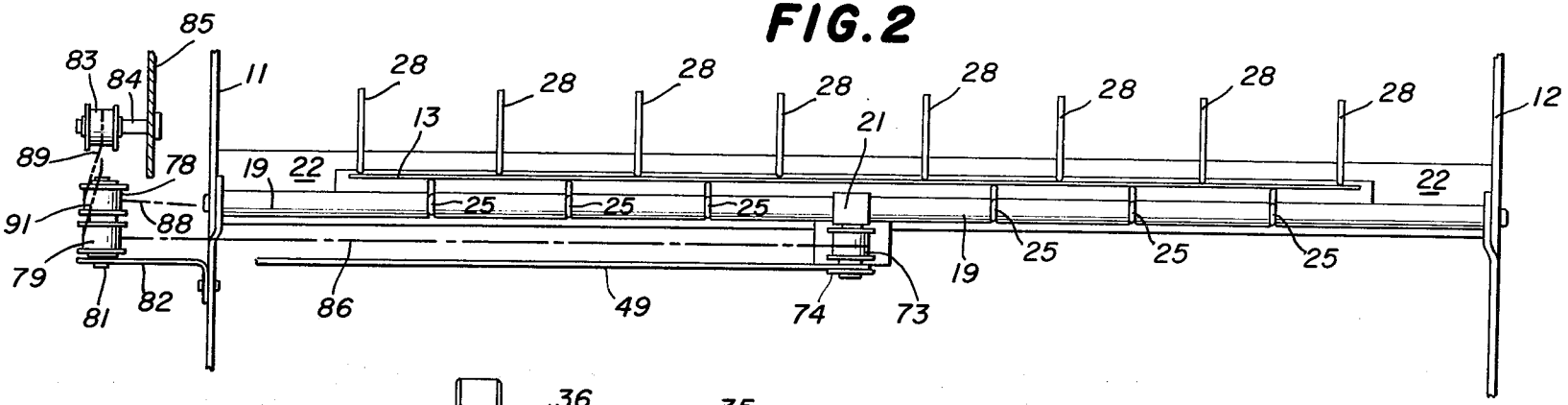
FIG. 2 is a top plan view, with the platen and other parts broken away, of a portion of the business machine shown in FIG. 1.

With particular reference to FIGS. 1, 2 and 4, document 13 is rearwardly supported by six spatially separated, rear vertical rods 24, each terminating in an upper, rearwardly extending hook portion 25 fitted into an annular recess in the horizontal rod 19, and a lower, straight portion 26 secured to the horizontal flange 22 of support 23, preferably by insertion into a hole therein. Forward support for document 13 is provided by eight front vertical rods 27 (FIGS. 1, 2 and 4) laterally offset with respect to rods 24, each rod 27 having an upper, forwardly diverging and downwardly extending portion 28 supported by known means (not shown), and a bottom portion 29 slidably disposed within an associated vertical bore or recess 31 in document support means 14. Rear rods 24 and front rods 27 cooperate, in conjuction with known roller means (not shown), to maintain document 13 against platen 10, as best shown in FIG. 4. The lower ends 26 of rear rods 24 are slidably disposed within bores 32 in document stop means 14. Rods 18, 24 and 27 provide means for guiding the document stop means 14 throughout its vertical travel to insure that its upper edge 15 remains horizontal and parallel to the longitudinal axis of platen 10.

Figure 5:
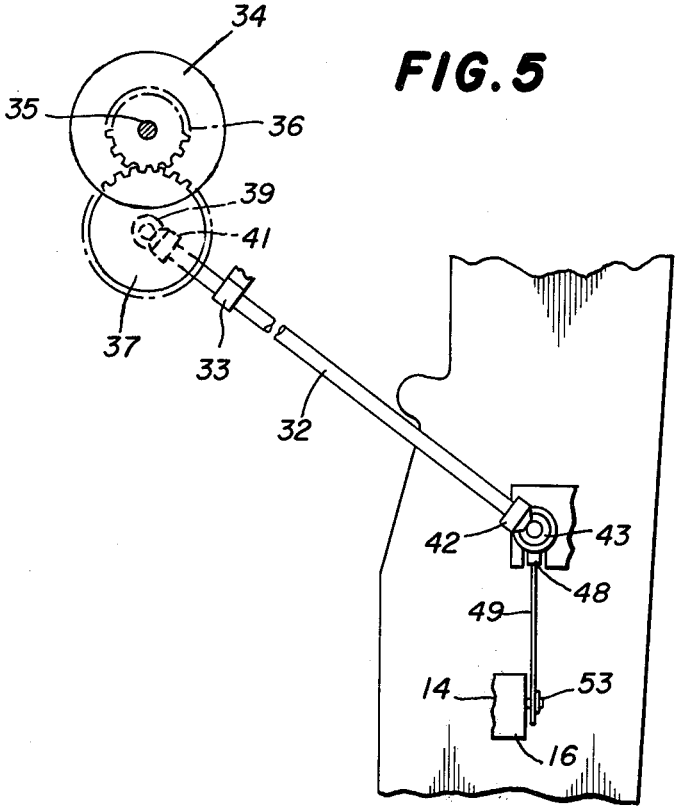
FIG. 5 is a side elevational view of the drive or elevating means, as seen from the left side of FIGS. 1 and 3, with parts broken away.

Manually operable means are provided for adjusting the printing position of document 13 relative to platen 10 by raising or lowering document stop means 14. Transfer means comprising a drive shaft 32 (FIGS. 3 and 5) is rotatably supported by a bracket 33 connected to a frame portion (not shown) of the business machine. Shaft 32 is downwardly and rearwardly extending from, and manually rotatable by, a knob 34 fastened to a horizontal mounting shaft 35 (FIG. 3). A gear 36, connected to knob 34 preferably through a suitable slip clutch (not shown), meshes with an idler gear 37 rotatably supported by a horizontal shaft 38 on which a bevel gear 39 is supported, the latter being secured to gear 37 and meshing with a bevel gear 41 securd to one end of shaft 32. Shafts 35 and 38 are rotatably supported by frame portions (not shown) of the business machine in a known manner. The lower end of shaft 32 has a bevel gear 42 secured thereto which meshes with a bevel gear 43 connected to a worm gear 44. The gears 43 and 44 are mounted on and secured to a shaft 45 supported by vertical frame sections 46, 47. Worm gear 44 meshingly engages a segment gear 48 (FIGS. 1 and 3) formed on one end of an arm 49 which is pivotally mounted by a pin 51 supported by the machine frame to be rotated, upon operation of knob 34, to effect vertical movement of document stop means 14 between lowest and highest positions thereof. Arm 49 is provided with a longitudinal slot 52 (FIGS. 1 and 3) at its other end for slidably receiving a pin 53 preferably integrally formed with the central portion 16 of document stop means 14. As best seen in FIG. 5, knob 34 preferably is located at the front of the business machine for ready access by the machine operator, document stop means 14 being disposed rearwardly therefrom.

The document stop and position indicator mechanism of the present invention further includes a flexible band indicated generally by reference numeral 54 (FIGS. 1, 4, 6 and 7) comprising an elongated plastic strip having ends 56, 57 (FIGS. 6 and 7) secured to document stop means 14, the latter having a vertically extending recess or aperture 58 therethrough for receiving an upper adjustment block 59 and a lower block 61. Blocks 59, 61 have horizintal bores 62 and 63 for tightly receiving plastic pins 64 and 65, respectively, each with one of the ends 56 and 57 partially wrapped around it, and then inserted into the associated bore 62, 63, in order to effect an inexpensive but secure friction-held fit of the ends of band 54 to blocks 59 and 61, respectively. Upper block 59 is adjustably held within recess 58 in central portion 16 of document stop means 14 by means of a set screw 66 (FIGS. 6 and 7) having a threaded portion 67 extending through a vertical slot 68 in central portion 16. Blocks 59 and 61 are interconnected by means of a spring 69 for maintaining tension in band 54.

With reference to FIGS. 1, 2 and 4, band guide means comprising plastic pulleys are provided for training band 54 past a viewing point comprising a window 71 mounted in an upper horizontal portion 72 of the business machine case. A pulley 73 is rotatably mounted on a horizontal pin 74 extending rearwardly from, and connected to, T-shaped fitting 21. A pulley 75 is mounted directly beneath pulley 73 by a horizontal pin 76 (FIG. 4) connected to a vertical portion 77 of L-shaped support 23. A pair of lower concentric pulleys, comprising a rear pulley 78 and a front pulley 79 (FIGS. 1 and 2), are rotatably mounted on a horizontal shaft 81 supported by an L-shaped bracket 82 connected to frame section 11. Finally, an upper pulley 83 (FIGS. 1 and 2) is mounted on a laterally extending horizontal shaft 84 connected to a frame section 85 beneath window 71.

As best shown in FIGS. 1 and 2, pulleys 73, 75, 78 and 79 guide a first portion of band 54 substantially parallel to the document stop means 14, while pulleys 78, 79 and 84 turn a second portion through 90° and back to align the band visually with window 71. Band 54 comprises a section 86 angularly disposed with respect to horizontal and extending over pulley 73 to join a vertical section 87, portions of the longitudinal axes of sections of band 54 being illustrated by phantom lines in FIG. 2. Vertical section 87 extends around pulley 75 to join a horizontal section 88 extending beneath pulley 78, section 88 being twisted 90° to form a section 89 extending over pulley 84. Section 89 joins a section 91 extending downwardly to pulley 79, where the latter section joins section 86.

Band 54 is calibrated or provided with appropriate indicia to indicate at viewing point 71 the printing position of document 13 supported by document stop means 14. Rotation of knob 34, as described earlier, serves to raise and lower document stop means 14 because end 56 is secured to adjustment block 59 and end 57 to block 61, and as the band 54 thus passes over pulleys 73, 75, 78, 79 and 83, the preferably numeric indicia thereon is displayed at viewing point 71 to indicate to the operator the particular line on a document supported by stop means 14 that is disposed in print-receiving position relative to the platen 10.

It is thought that the invention and many of its attendant advantages will be understood from the foregoing description and it will be apparent that various changes may be made in the form, construction and arrangement of the component parts without departing from the spirit and scope of the invention or sacrificing all of its material advantages, the form described being merely a preferred embodiment thereof.

The embodiments of the invention in which an exclusive property or privilege is claimed are defined as follows:

1. In a business machine having a printer and a platen for backing a document during printing, a document stop and position indicator mechanism comprising: movable document stop means for supporting a document at a preselected printing position relative to the platen, means for guiding said document stop means, manually operable means for adjusting the printing position of a document supported by said stop means by moving the latter, a flexible band, band guide means for training said band past a viewing point, said band being calibrated to identify at said point the print-receiving portion of said document then disposed in printing position, said document stop means comprising an aperture and first and second blocks slidably disposed therewithin, each said end of said flexible band being secured to an associated said block, one of said blocks being adjustably secured to said document stop means, and means for interconnecting said blocks.

2. The document stop and position indicator mechanism of claim 1, wherein said document stop means is vertically adjustable and comprises a vertical aperture for slidably receiving said first and second blocks secured to ends of said flexible band, and wherein said means for interconnecting said blocks comprises an extension spring to maintain band tension.

3. The document stop and position indicator mechanism of claim 2, wherein each said block comprises a horizontal bore for tightly receiving a pin, each said end being partially wrapped about an associated said pin prior to insertion thereof into a said bore.

4. In a business machine having a printer and a platen for backing a document during printing, a document stop and position indicator mechanism comprising: movable document stop means for supporting a document at a preselected printing position relative to the platen, means for guiding said document stop means, manually operable means comprising a manually rotatable drive shaft mounting gearing for adjusting the printing position of a document supported by said stop means by moving the latter, a flexible band having ends thereof secured to said document stop means, band guide means for training said band past a viewing point, said band being calibrated to identify at said point the print-receiving portion of said document then disposed in printing position, and a gear linkage connected to said document stop means and drivingly engaged by said gearing, said linkage comprising an arm secured to a segment gear in meshing relation with a worm gear constituting part of said gearing.

5. The document stop and position indicator mechanism of claim 4, wherein said arm includes a longitudinal slot, and a pin integrally connected to said document stop means and slidably disposed in said slot.

* * * * *